US007654049B2

(12) United States Patent
Koenig, Jr. et al.

(10) Patent No.: US 7,654,049 B2
(45) **Date of Patent: *Feb. 2, 2010**

(54) CROWN MOLDING MEMBER HAVING PLANAR PORTION, INTERMEDIATE PORTION, AND MOUNTING FLANGE

(75) Inventors: Joseph M. Koenig, Jr., Glenview, IL (US); Mark Budzik, Niles, IL (US)

(73) Assignee: Trim-Tex, Inc., Lincolnwood, IL (US)

( * ) Notice: Subject to any disclaimer, the term of this patent is extended or adjusted under 35 U.S.C. 154(b) by 691 days.

This patent is subject to a terminal disclaimer.

(21) Appl. No.: 10/774,798

(22) Filed: Feb. 9, 2004

(65) Prior Publication Data

US 2005/0193664 A1 Sep. 8, 2005

(51) Int. Cl.
*E04B 2/00* (2006.01)
*E04B 1/00* (2006.01)
*E04C 2/38* (2006.01)

(52) U.S. Cl. ..... 52/287.1; 52/718.01; 52/288.1; 52/255

(58) Field of Classification Search ..... 52/287.1, 52/288.1, 716.1, 255, 94, 96, 220.7, 481.2, 52/717.05, 718.01, 256, 718.1, 718.03, 707.05, 52/364; D25/136; 174/492
See application file for complete search history.

(56) References Cited

U.S. PATENT DOCUMENTS

| | | | | | |
|---|---|---|---|---|---|
| 388,286 | A | | 8/1888 | Kinnear | |
| 417,949 | A | | 12/1889 | Sagendorph | |
| 424,312 | A | * | 3/1890 | Kinnear | 52/288.1 |
| 906,218 | A | | 12/1908 | Goddard | |
| 1,046,528 | A | * | 12/1912 | Williamson | 52/288.1 |
| 1,205,358 | A | * | 11/1916 | Knapp | 52/280 |
| 1,629,848 | A | * | 5/1927 | Wingate | 52/718.05 |
| D77,269 | S | * | 12/1928 | Toney | D25/136 |
| D77,270 | S | * | 12/1928 | Toney | D25/136 |
| 1,813,173 | A | * | 7/1931 | Kuehn | 52/255 |
| 1,825,010 | A | * | 9/1931 | Hayes | 52/288.1 |
| 1,856,167 | A | | 5/1932 | Overholtz | |

(Continued)

FOREIGN PATENT DOCUMENTS

CA 2290770 * 11/1999

(Continued)

OTHER PUBLICATIONS

Two pages copied from Trim-Tex 2003-2004 Catalog—see Stock Nos. 7208, 7210, 7258, 7250, 7360, 7068, 7066, 7062—admitted prior art.

*Primary Examiner*—Richard E Chilcot, Jr.
*Assistant Examiner*—Elizabeth A Plummer
(74) *Attorney, Agent, or Firm*—Wood, Phillips, Katz, Clark & Mortimer

(57) ABSTRACT

As used to trim a corner where a wall and a ceiling meet, a crown molding member has a planar portion, an intermediate portion, and a mounting flange. The planar portion is attached to the ceiling, in a first mode, or to the wall, in a second mode. The intermediate portion may have a coved, stepped, or curved profile. When applied to the mounting flange, drywall-finishing material, so-called "mud" in trade parlance, is pressed through apertures in the mounting flange, against the wall, in the first mode, or against the ceiling, in the second mode.

11 Claims, 2 Drawing Sheets

U.S. PATENT DOCUMENTS

| | | | | | |
|---|---|---|---|---|---|
| 2,029,549 | A | * | 2/1936 | Winterich | 52/288.1 |
| 2,569,916 | A | * | 10/1951 | Barnes, Sr. et. al. | 52/255 |
| 3,047,112 | A | * | 7/1962 | Tvorik et. al. | 52/288.1 |
| 3,201,910 | A | | 8/1965 | Keesee | |
| 3,616,587 | A | | 11/1971 | Schlafly, Jr. | |
| 4,622,791 | A | * | 11/1986 | Cook et al. | 52/241 |
| 4,722,153 | A | * | 2/1988 | Hardy | 52/255 |
| 5,001,877 | A | * | 3/1991 | Edwards | 52/288.1 |
| 5,243,800 | A | * | 9/1993 | Olbrich | 52/287.1 |
| 5,398,469 | A | | 3/1995 | Logan | |
| 5,426,901 | A | | 6/1995 | Indracek | |
| 5,433,048 | A | | 7/1995 | Strasser | |
| 5,457,923 | A | | 10/1995 | Logan et al. | |
| 5,560,158 | A | * | 10/1996 | Norton | 52/95 |
| 5,560,175 | A | * | 10/1996 | Soyka et al. | 52/716.5 |
| 5,598,681 | A | * | 2/1997 | DiGianni | 52/717.05 |
| 5,694,726 | A | * | 12/1997 | Wu | 52/287.1 |
| 5,740,642 | A | | 4/1998 | Koenig et al. | |
| 5,904,016 | A | | 5/1999 | Koenig et al. | |
| 6,050,037 | A | * | 4/2000 | Gifford | 52/211 |
| 6,212,835 | B1 | * | 4/2001 | Schiedegger et al. | 52/211 |
| 6,253,510 | B1 | | 7/2001 | Santarossa | |
| 6,477,818 | B1 | | 11/2002 | Jensen | |
| 6,539,675 | B1 | * | 4/2003 | Gile | 52/96 |
| 6,643,990 | B2 | | 11/2003 | Jensen | |
| 6,837,020 | B1 | | 1/2005 | Keddell | |
| 6,865,849 | B1 | * | 3/2005 | Mollinger et al. | 52/96 |
| 7,036,282 | B1 | * | 5/2006 | Keddell | 52/287.1 |
| 7,228,663 | B2 | * | 6/2007 | Schiedegger et al. | 52/211 |
| 2004/0045239 | A1 | | 3/2004 | Milu | |
| 2005/0183352 | A1 | * | 8/2005 | Koenig et al. | 52/211 |
| 2005/0193664 | A1 | * | 9/2005 | Koenig et al. | 52/287.1 |
| 2006/0272237 | A1 | * | 12/2006 | Koenig et al. | 52/211 |

FOREIGN PATENT DOCUMENTS

| | | | |
|---|---|---|---|
| CA | 2 477 501 | * | 8/2005 |
| CA | 2 468 000 | * | 11/2005 |
| CA | 2 509 722 | * | 11/2006 |
| GB | 2 191 518 | * | 12/1987 |

* cited by examiner

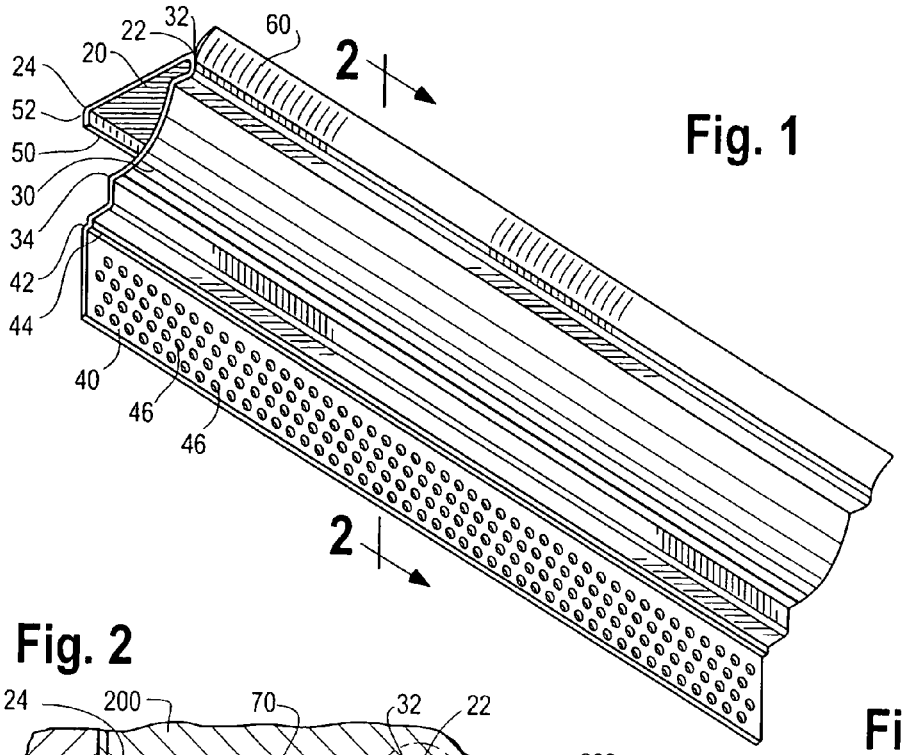
Fig. 1
Fig. 2
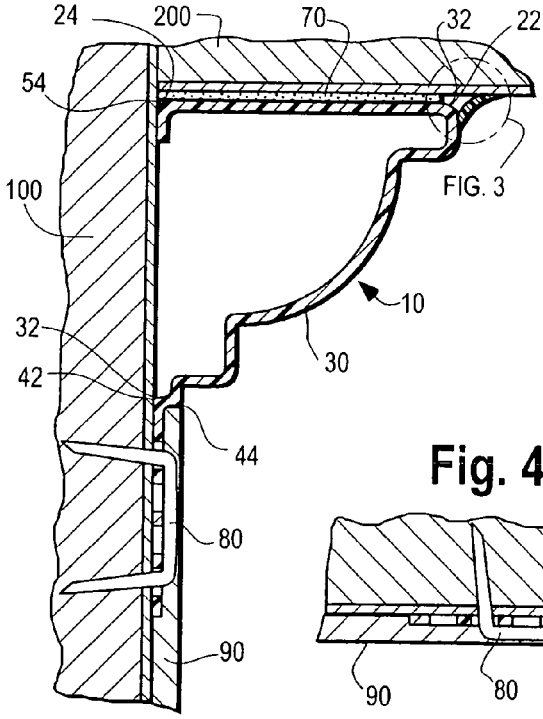
Fig. 3
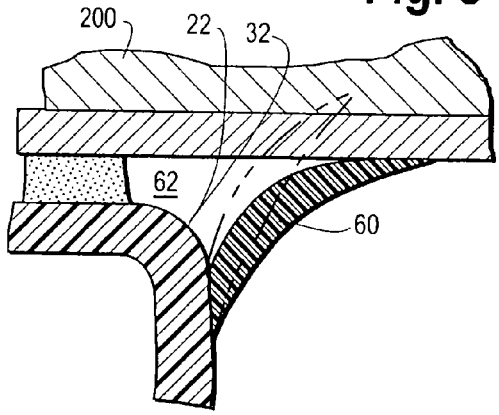
Fig. 4
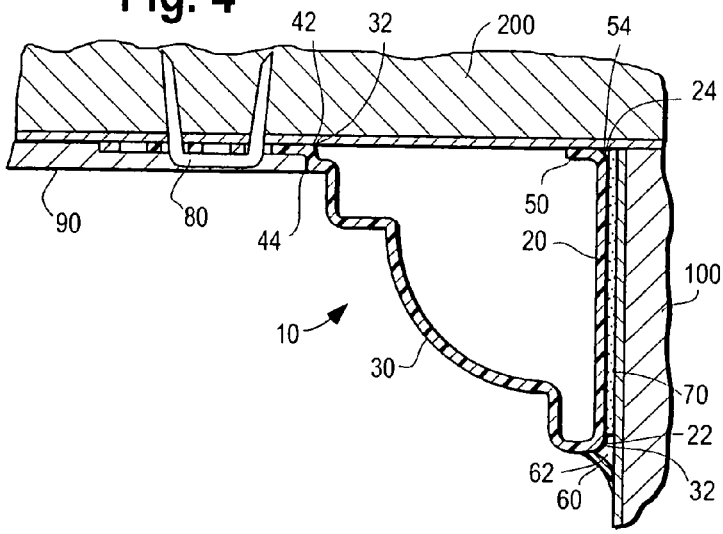

CROWN MOLDING MEMBER HAVING PLANAR PORTION, INTERMEDIATE PORTION, AND MOUNTING FLANGE

TECHNICAL FIELD OF THE INVENTION

This invention pertains to a crown molding member, of a type used to trim an interior corner defined where a wall and a ceiling meet. This invention contemplates that the crown molding member has a mounting flange, to which drywall-finishing material, so-called "mud" in trade parlance, is applicable.

BACKGROUND OF THE INVENTION

A crown molding member of the type noted above is exemplified in U.S. Pat. No. 6,477,818 B1 and No. 6,643,990 B2, which disclose that an upper, horizontal, "alignment" portion of the crown molding member is attached adhesively to a ceiling panel, via a tape coated on both sides with an adhesive, that a back edge of the upper, horizontal, "alignment" portion abuts a wall panel but is not attached to the wall panel, and that a lower edge of an angled face of the crown molding member abuts the wall panel but is not attached to the wall panel.

SUMMARY OF THE INVENTION

This invention provides a crown molding member, which is useful to trim a corner defined where a vertical wall and a horizontal ceiling meet and which is installable in two modes. Broadly, the crown molding member has a planar portion, an intermediate portion, and a mounting flange, as described below. Further, the crown molding member may have an additional flange, a flexible fin, or both, as described below. Because of its overall profile, the crown molding member can be stably positioned in a miter box, for mitering of either of its ends.

The planar portion, which extends along the horizontal ceiling when the crown molding member is installed in a first mode and which extends along the vertical wall when the crown molding member is installed in a second mode, has a proximal edge, which is proximal to the vertical wall when the crown molding member is installed in the first mode and which is proximal to the horizontal ceiling when the crown molding member is installed in the second mode, and a distal edge, which is spaced from the proximal edge of the planar portion.

The intermediate portion, which may have a coved, curved, or stepped profile or an arbitrary profile, adjoins the distal edge of the planar portion at a distal edge of the intermediate portion. The intermediate portion has a proximal edge, which is spaced from the distal edge of the intermediate portion.

The mounting flange, which adjoins the proximal edge of the intermediate strip at an adjoining edge of the mounting flange, extends along the vertical wall, away from the horizontal ceiling, when the crown molding member is installed in the first mode and extends along the horizontal ceiling, away from the vertical wall, when the crown molding member is installed in the second mode.

If provided, the additional flange adjoins the proximal edge of the planar portion at an adjoining edge of the additional flange. The additional flange extends along the vertical wall, toward the mounting flange, when the crown molding member is installed in the first mode. The additional flange extends along the horizontal ceiling, toward the mounting flange, when the crown molding member is installed in the second mode.

If provided, the flexible fin points away from the planar portion. The flexible fin bears against the horizontal ceiling when the crown molding member is installed in the first mode. The flexible fin bears against the vertical wall when the crown molding member is installed in the second mode.

Preferably, the mounting flange has an array of apertures. Thus, when drywall-finishing material is applied to the mounting flange some of the applied material can be then pressed through at least some of the apertures, against the vertical wall, in the first mode, or against the ceiling, in the second mode.

BRIEF DESCRIPTION OF THE DRAWINGS

FIG. 1 is an isometric view of a crown molding member embodying this invention. As illustrated in FIG. 1, the crown molding member has an arbitrary length, which is exemplary, not limiting.

FIG. 2 is a sectional view taken along line 2-2 of FIG. 1, in a direction indicated by arrows, and showing the crown molding member, as installed in a first implementation of the first mode, so as to trim an interior corner where a wall and a ceiling meet. FIG. 3, on a larger scale, is a detail taken where indicated in FIG. 2.

FIG. 4 is a sectional view, which is taken similarly, and which shows the crown molding member, as installed in a second mode, so as to trim an interior corner where a wall and a ceiling meet.

DETAILED DESCRIPTION OF THE ILLUSTRATED EMBODIMENTS

Figure 5:
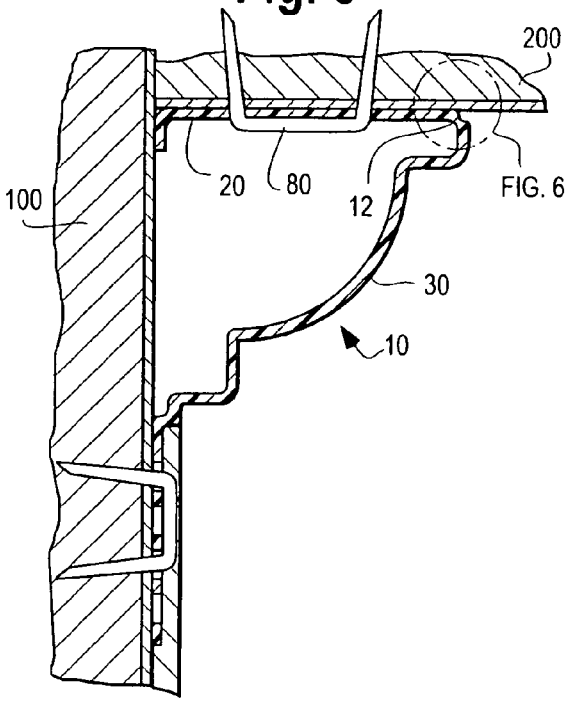
FIG. 5 is a sectional view, which is taken similarly, and which shows the crown molding member, as installed in a second implementation of the first mode, so as to trim an interior corner where a wall and a ceiling meet.

As illustrated in FIG. 1, a crown molding member 10 embodying this invention has a planar portion 20, which has a distal edge 22 and a proximal edge 24, an intermediate portion 30, which has a distal edge 32 adjoining the distal edge 22 of the planar portion 20 and which has a proximal edge 34, which is spaced from the distal edge 32 of the intermediate portion 30, a mounting flange 40 having an adjoining edge 42 adjoining the distal edge 34 of the intermediate portion 30, an additional flange 50 having an adjoining edge 54 adjoining the proximal edge 24 of the planar portion 20, and a flexible fin 60 projecting from the intermediate portion 30, near the distal edge 32 of the planar portion 30.

The intermediate portion 30 may have a coved, curved, or stepped profile or an arbitrary profile. A step 44 is defined where the adjoining edge 42 of the mounting flange 40 adjoins the proximal edge 34 of the intermediate portion 30. The mounting flange 40 has an array of apertures 46, such as circular holes, which are illustrated, or such as elongate slots. The flexible fin 60 is co-extruded with the other portions of the crown molding member 10.

Preferably, except for the flexible fin 60 and except for a so-called "living" hinge, if provided, as discussed below, the crown molding member 10 is extruded so as to have a substantially uniform thickness of approximately 0.060 inch to approximately 0.070 inch, except as discussed below. Preferably, the flexible fin 60 and the other portions of the crown molding member are co-extruded, the flexible fin 60 being extruded from a comparatively softer, more flexible, polymeric material, such as polyvinyl chloride having a hardness of Durometer 92 Shore A and the other portions of the crown molding member 10 being extruded from a comparatively harder, less flexible, polymeric material, such as polyvinyl chloride having a hardness of Durometer Shore 82 D.

As illustrated in FIG. 2, the crown molding member 10 is installed in a first mode, so as to trim an interior corner where a wall 100 and a horizontal ceiling 200 meet. The vertical wall 100 and the horizontal ceiling 200 are defined by drywall panels having gypsum cores and having paper faces. Thus, the planar portion 20 extends horizontally, beneath and along the horizontal ceiling 200, to which the planar portion 20 is attached. In a preferred implementation via an adhesive means 70, such as a sprayed adhesive or a double-faced, adhesive tape. Trim-Tex 847™ Spray Adhesive, which is available commercially from Trim-Tex, Inc. of Lincolnwood, Ill., is a preferred means.

As illustrated in FIG. 2, the proximal edge 24 of the planar portion 20 is proximal to the vertical wall 100. Also, the additional flange extends along the vertical wall, toward the mounting flange. Also, the mounting flange 40 extends downwardly, along the vertical wall 100, away from the horizontal ceiling 200. Moreover, the additional flange 50 extends downwardly, beside and along the vertical wall 100, toward the mounting flange 40. Moreover, the flexible fin 60 bears upwardly against the horizontal ceiling 200, so as to close a pocket 62 formed where the distal edge 32 of the intermediate portion 30 adjoins the distal edge 22 of the planar portion 20.

Furthermore, this contemplates that, when the crown molding member 10 is installed in the first mode when drywall-finishing material 80, the mounting flange 40 is attached to the vertical wall 100 via mechanical fasteners 80, such as wire staples with diverging legs, one such staple being shown. Moreover, when drywall-finishing material 90, so-called "mud" in trade parlance, is applied to the mounting flange 40, some of the applied material 90 can be then pressed through at least some of the apertures 46, against the vertical wall 100. The step 44 facilitates spreading of such material 90 with a drywall-finishing blade.

As illustrated in FIG. 4, the crown molding member 10 is installed in a second mode, so as to trim the interior corner where the vertical wall 100 and the horizontal ceiling 200 meet. Thus, the planar portion 20 extends downwardly, beside and along the horizontal wall 100, to which the planar portion 20 is attached via the adhesive means 70. Also, the proximal edge 24 of the planar portion 20 is proximal to the wall 100. Moreover, the additional flange 50 extends downwardly, beside and along the vertical wall 100, toward the mounting flange 40. Moreover, the flexible fin 60 bears laterally against the vertical wall 100, so as to close a pocket 62 formed where the distal edge 32 of the intermediate portion 30 adjoins the distal edge 22 of the planar portion 20.

Furthermore, this invention contemplates that, when the crown molding member 10 is installed in the second mode, the mounting flange 40 is attached to the horizontal ceiling 200 via mechanical fasteners 80, such as wire staples with diverging legs, one such staple being shown. Moreover, when drywall-finishing material 90, so-called "mud" in trade parlance, is applied to the mounting flange 40, some of the applied material 90 can be then pressed through at least some of the apertures 46, against the horizontal ceiling 200. The step 44 facilitates spreading of such material 90 with a drywall-finishing blade.

Figure 7:
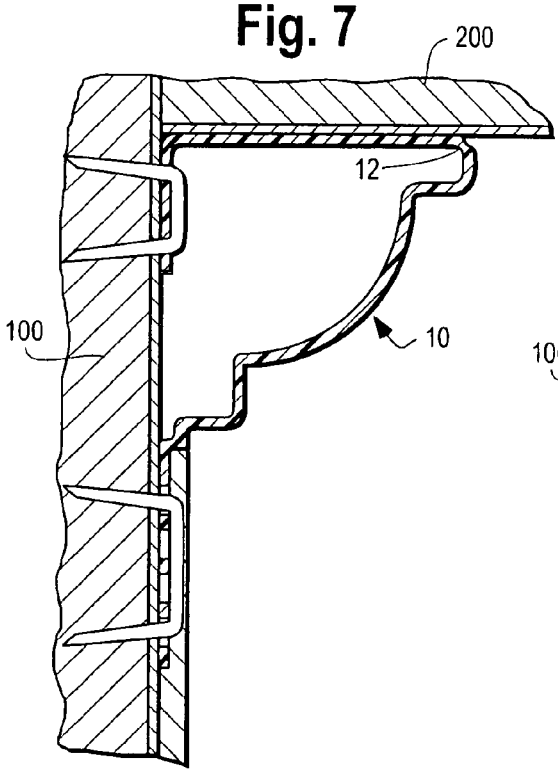
FIG. 7 is a sectional view, which is taken similarly, and which shows the crown molding member, as installed in a third implementation of the first mode, so as to trim an interior corner where a wall and a ceiling meet.

As illustrated in FIG. 5, the crown molding member 10 is installed in the first mode, in a second implementation differing from other implementations of the first mode, as discussed herein, in that the planar portion 20 is attached to the horizontal ceiling 200 via mechanical fasteners 80, such as wire staples with diverging legs, one such staple being shown. As illustrated in FIG. 7, the crown molding member 10 is installed in the first mode, in a third implementation differing from other implementations of the first mode, as discussed herein, in that the additional flange 50 is attached to the vertical wall 100 via mechanical fasteners 80, such as wire staples with diverging legs, one such staple being shown. As illustrated in FIG. 7, the additional flange 50 is lengthened so as to accommodate such fasteners 80. In the second or third implementation of the second mode, the planar portion 20 may be also attached adhesively to the horizontal ceiling 200, as described above.

Figure 6:
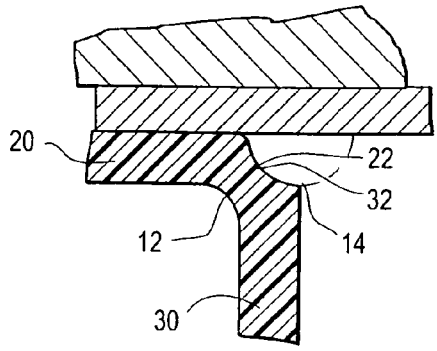
FIG. 6, on a larger scale, is a detail taken where indicated in FIG. 5.

As illustrated in FIGS. 5, 6, and 7, so as to facilitate flexing of the crown molding member 10 for entry of a fastener-driving tool, the crown molding member 10 is thinner, as compared to the generally uniform thickness discussed above, so as to form a so-called "living" hinge 12 where the distal edge 32 of the intermediate portion 30 adjoins the distal edge 22 of the planar portion 20. As illustrated in a broken line in FIG. 6, a caulk bead 14 may be optionally applied along crown molding member 10, where the so-called "living" hinge 12 is formed, so as to adhere to the horizontal ceiling 200, after the crown molding member 10 has been installed in the second or third implementation of the second mode.

Figure 8:
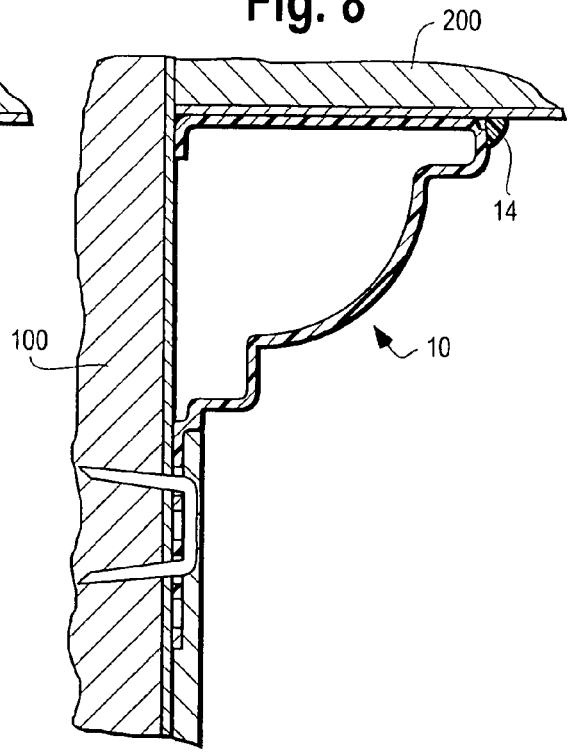
FIG. 8 is a sectional view, which is taken similarly, and which shows the crown molding member, as installed in a third implementation of the first mode, so as to trim an interior corner where a wall and a ceiling meet.

As illustrated in FIG. 8, the crown molding member 10 is installed in the first mode, in a fourth implementation differing from other implementations of the first mode, as discussed herein, in that a caulk bead 14 is applied along the crown molding member 10, where the distal edge 32 of the intermediate portion 30 adjoins the distal edge 22 of the planar portion 20, so as to adhere to the horizontal ceiling 200, after the crown molding member 10 has been installed. In the fourth implementation of the second mode, the planar portion 20 may be also attached adhesively to the horizontal ceiling 200, as described above.

As illustrated in the drawings and described herein, the first mode in its various implementations is differentiated from the second mode because of the rotational orientation of the crown molding member 10 relative to an imaginary axis, which is parallel to the vertical wall 100 and to the horizontal ceiling 200.

The invention claimed is:

1. A crown molding member, which is useful to trim a corner defined where a vertical wall and a horizontal ceiling meet, the crown molding member having a planar portion, which extends along the horizontal ceiling when the crown molding member is installed in a first mode and which extends along the vertical wall when the crown molding member is installed in a second mode, the planar portion having a proximal edge, the planar portion having a distal edge, which is spaced from the proximal edge of the planar portion, the crown molding member having an intermediate portion, which adjoins the distal edge of the planar portion at a distal edge of the intermediate portion, the intermediate portion having a proximal edge, which is spaced from the distal edge of the intermediate portion, the crown molding member having a mounting flange, which adjoins the proximal edge of the intermediate strip at an adjoining edge of the mounting flange, which extends along the vertical wall, when the crown molding member is installed in the first mode and which extends along the horizontal ceiling, when the crown molding member is installed in the second mode, wherein the planar portion extends from the distal edge of the intermediate portion toward the corner with the crown member installed in either the first mode or the second mode, the crown molding member having a flexible fin, which projects from the planar portion, near the distal edge of the planar portion, which bears against the horizontal ceiling when the crown molding member is installed in the first mode, and which bears against the vertical wall when the crown molding member is installed in the second mode.

2. The crown molding member of claim 1, wherein the mounting flange has an array of apertures.

3. The crown molding member of claim 2, as installed in the first mode so as to trim a corner defined where a vertical wall and a horizontal ceiling meet, wherein drywall-finishing material is applied to the mounting flange so that some of the applied material is pressed through at least some of the apertures, against the vertical wall.

4. The crown molding member of claim 3, wherein the planar portion is attached to the horizontal ceiling.

5. The crown molding member of claim 2, as installed in the second mode so as to trim a corner defined where a vertical wall and a horizontal ceiling meet, wherein drywall-finishing material is applied to the mounting flange so that some of the applied material is pressed through at least some of the apertures, against the horizontal ceiling.

6. The crown molding member of claim 5, wherein the planar portion is attached to the vertical wall.

7. The crown molding member of claim 1, wherein the proximal edge of the planar portion is proximal to the vertical wall when the crown molding member is installed in the first mode and wherein the proximal edge of the planar portion is proximal to the horizontal ceiling when the crown molding member is installed in the second mode.

8. The crown molding member of claim 7, wherein the mounting flange is attached to the vertical wall by means besides the applied material.

9. The crown molding member of claim 8, wherein the mounting flange is attached to the horizontal ceiling by means besides the applied material.

10. A crown molding member, which is useful to trim an inside corner defined where a vertical wall and a horizontal ceiling meet, the crown molding member having a planar portion, which extends along the horizontal ceiling of the inside corner when the crown molding member is installed in a first mode and which extends along the vertical wall of the inside corner when the crown molding member is installed in a second mode, the planar portion having a proximal edge, the planar portion having a distal edge, which is spaced from the proximal edge of the planar portion, the crown molding member having an intermediate portion, which adjoins the distal edge of the planar portion at a distal edge of the intermediate portion, the intermediate portion having a proximal edge, which is spaced from the distal edge of the intermediate portion, the crown molding member having a mounting flange, which adjoins the proximal edge of the intermediate strip at an adjoining edge of the mounting flange, which extends along the vertical wall, when the crown molding member is installed in the first mode and which extends along the horizontal ceiling, when the crown molding member is installed in the second mode which has a generally uniform thickness, except that the crown molding member is thinner where the distal edge of the intermediate portion adjoins the distal edge of the planar portion, whereby to form a hinge where the crown molding member is thinner, the crown molding member, as installed in the first mode, wherein the planar portion is attached to the horizontal ceiling by mechanical fasteners, wherein a caulk bead is applied where the hinge is formed.

11. A crown molding member, which is useful to trim an inside corner defined where a vertical wall and a horizontal ceiling meet, the crown molding member having a planar portion, which extends along the horizontal ceiling of the inside corner when the crown molding member is installed in a first mode and which extends along the vertical wall of the inside corner when the crown molding member is installed in a second mode, the planar portion having a proximal edge, the planar portion having a distal edge, which is spaced from the proximal edge of the planar portion, the crown molding member having an intermediate portion, which adjoins the distal edge of the planar portion at a distal edge of the intermediate portion, the intermediate portion having a proximal edge, which is spaced from the distal edge of the intermediate portion, the crown molding member having a mounting flange, which adjoins the proximal edge of the intermediate strip at an adjoining edge of the mounting flange, which extends along the vertical wall, when the crown molding member is installed in the first mode and which extends along the horizontal ceiling, when the crown molding member is installed in the second mode which has a generally uniform thickness, except that the crown molding member is thinner where the distal edge of the intermediate portion adjoins the distal edge of the planar portion, whereby to form a hinge where the crown molding member is thinner, the crown molding member, as installed in the second mode, wherein the planar portion is attached to the vertical wall by mechanical fasteners, wherein a caulk bead is applied where the hinge is formed.

* * * * *

UNITED STATES PATENT AND TRADEMARK OFFICE

CERTIFICATE OF CORRECTION

PATENT NO. : 7,654,049 B2
APPLICATION NO. : 10/774798
DATED : February 2, 2010
INVENTOR(S) : Koenig, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1289 days.

Signed and Sealed this

Twenty-third Day of November, 2010

David J. Kappos

David J. Kappos
*Director of the United States Patent and Trademark Office*